US010054976B2

(12) United States Patent
Fremiot et al.

(10) Patent No.: US 10,054,976 B2
(45) Date of Patent: Aug. 21, 2018

(54) REMOTE CONTROLLER FOR MACHINERY

(71) Applicant: Robert Bosch GmbH, Stuttgart (DE)

(72) Inventors: Guillaume Fremiot, Orliénas (FR); Benjamin Dollhofer, Ottersweier (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/341,043

(22) Filed: Nov. 2, 2016

(65) Prior Publication Data

US 2017/0131737 A1 May 11, 2017

(30) Foreign Application Priority Data

Nov. 6, 2015 (FR) ..... 15 60647

(51) Int. Cl.
*G05G 9/047* (2006.01)
*G05G 1/04* (2006.01)

(52) U.S. Cl.
CPC ..... *G05G 9/047* (2013.01); *G05G 1/04* (2013.01); *G05G 2009/0474* (2013.01); *G05G 2009/04703* (2013.01); *G05G 2009/04714* (2013.01); *G05G 2009/04718* (2013.01); *G05G 2009/04748* (2013.01)

(58) Field of Classification Search
CPC ..... G05G 1/04; G05G 2009/04703; G05G 2009/04714; G05G 2009/04718; G05G 2009/04748; F16H 59/0204; F16H 59/10; F16H 2059/0273; A63F 13/24; B64C 13/0421
USPC ..... 74/471 XY, 469, 471 R, 491, 519, 523, 74/524; 345/161; 463/38; 244/234
See application file for complete search history.

(56) References Cited

U.S. PATENT DOCUMENTS 5,142,931 A * 9/1992 Menahem ..... G05G 9/047 244/234
6,429,849 B1 * 8/2002 An ..... G05G 9/047 345/161
6,512,509 B1 1/2003 McVicar
8,033,197 B2 * 10/2011 Larson ..... B64C 13/04 384/517
2011/0148666 A1 * 6/2011 Hanlon ..... G05G 5/03 340/971
2016/0252926 A1 * 9/2016 Gomolko ..... G05G 5/03 244/234

FOREIGN PATENT DOCUMENTS

WO 01/65328 A1 9/2001

* cited by examiner

*Primary Examiner* — Victor L Macarthur
*Assistant Examiner* — Joseph H Brown
(74) *Attorney, Agent, or Firm* — Maginot, Moore & Beck LLP

(57) ABSTRACT

A remote controller includes a fixed body equipped with pivots in a first axis and pivots in a second axis, together with an operating lever. The remote controlling further includes a main frame configured to pivot about the axes to transmit pivoting movement of the lever to a pivoting sensor. The main frame is coupled by pivots to the lever. The lever has two pairs of arms to control the pivoting of the main frame and the pivoting of the auxiliary frame. The auxiliary frame is coupled to the lever by an intermediate frame. The intermediate frame is coupled to the auxiliary frame by a swivel. The frames are located under a plane of the axes and the lever is located above the plane of the axes.

9 Claims, 4 Drawing Sheets

REMOTE CONTROLLER FOR MACHINERY

This application claims priority under 35 U.S.C. § 119 to patent application no. FR 1 560 647, filed on Nov. 6, 2015 in France, the disclosure of which is incorporated herein by reference in its entirety.

The present disclosure relates to a remote controller for machinery, comprising a remote controller casing equipped with a lever actuated by the user and means for linking the lever to the casing, enabling the lever to move relative to the casing about two axes (X,Y), together with means for detecting the relative movement of the lever with respect to the casing, for the purpose of generating control signals for the machinery with which the remote controller is associated.

BACKGROUND

The document U.S. Pat. No. 6,512,509 (Logitec) describes a two-axis remote control mechanism for video game applications. It has the drawback of being insufficiently robust for engineering and industrial applications requiring a long service life of more than 5,000,000 cycles and the ability to withstand maximum forces of about 100 kg.

The fragility of this mechanism is due to the reduction of its structure to two pivots, one for each of the axes of rotation, as a result of which the torsional forces are exerted on the links and make the whole structure fragile.

According to the document WO 0165 328 (Microsoft), the mechanism is reinforced by two supplementary pivots; that is to say, there are two pivots per axis, reducing the torsional forces. However, the device described is relatively complex and is unsuitable for mobile equipment that must withstand the operating conditions outlined above. To provide this degree of mechanical strength, the dimensions of the elements would have to be increased, particularly in the transverse directions X and Y, which would prevent the incorporation of the device in mobile equipment such as the cab of a construction machine.

SUMMARY

The object of the present disclosure is to develop a remote controller mechanism for engineering machinery such as construction machinery or civil engineering machinery, operating on two axes with a return to a neutral point, which is simple to construct, highly compact and strong.

To this end, the disclosure proposes a remote controller of the type defined above, characterized in that it comprises: a fixed body having pivots defining the X axis and the Y axis, which cut each other at a geometric point about which the lever pivots, a main frame pivoting with respect to the casing on two pivots carried by the casing in the X axis, the pivoting movement of which frame is detected by a sensor, an auxiliary frame, pivoting with respect to the casing by means of the two pivots carried by the casing in the Y axis, the movement of which frame is detected by a sensor, an intermediate frame coupled to the auxiliary frame by a swivel, a control lever, equipped with two pairs of arms fixed to the lever, extending from the geometric pivot defined by the intersection of the X and Y axes, one of these pairs interacting with the main frame and the other interacting with the auxiliary frame via the intermediate frame, the lever being movable on one side of the plane of the main frame, the auxiliary frame and the intermediate frame being located on the other side of the plane of the pairs of arms, the movement of the control lever being transmitted to the sensor of the pivoting movement about the X axis by the arms of the lever associated with the main frame, and to the sensor of the movement about the Y axis by the pair of arms of the lever associated with the intermediate frame coupled to the auxiliary frame.

The remote controller according to the disclosure has the advantage of having a particularly strong structure, because it has, notably, two pivots associated with each pivot axis of the control lever, but also an extremely simple and compact structure, enabling it to be incorporated easily into engineering equipment such as the control cab of a construction machine, at the position of the armrest, since this location has to have particularly small overall dimensions because of the limited space available in the control cab and the need for easy access to the cab.

According to one characteristic, the pivots of the main frame are formed by two shaft elements engaged in fixed bearings aligned on the axis of the casing and forming part of the casing.

According to another characteristic, the auxiliary frame is a U-shaped part whose two branches terminate in two pivots formed by shaft elements housed in the fixed bearings of the casing.

According to another characteristic, the intermediate frame is a U-shaped part whose branches are equipped with pivots formed by auxiliary bearings receiving the second pair of arms of the lever, the transverse branch of the intermediate frame being coupled to the intermediate branch of the auxiliary frame by a swivel joint.

The assembly thus formed with the pivots provides a reliable structure which can withstand the conditions encountered by remote controllers of construction or civil engineering machines or other machines of this type.

According to an advantageous characteristic, the axes are orthogonal, and the branches of the lever are orthogonal.

According to another advantageous characteristic, the auxiliary frame and the intermediate frame are symmetrical and their swivel joint is located in the middle of the transverse branch of each of the frames. This swivel is, notably, a bearing whose axis passes through the pivot of the lever.

According to another characteristic, the auxiliary frame and the intermediate frame are movable under the plane of the X and Y axes, and the lever 5 is movable above this plane of the X and Y axes.

According to another embodiment of the disclosure a remote controller for machinery comprises a casing equipped with (i) a control lever actuated by the user, (ii) a linking component configured to link the control lever to the casing and to enable the control lever to move relative to the casing about a first axis and a second axis, (iii) a detecting device configured to detect relative movement of the control lever with respect to the casing for generating control signals for the machinery with which the remote controller is associated, and a fixed body having a first pivot and a second pivot defined by the first axis and a third pivot and a fourth pivot defined by the second axis, the first axis and the second axis intersecting each other at a geometric point about which the control lever is configured to pivot. The remote controller further comprises a main frame configured to pivot with respect to the casing by way of the first pivot and the second pivot, the main frame carried by the casing in the first axis, and pivoting movement of the main frame detected by a first sensor, an auxiliary frame configured to pivot with respect to the casing by way of the third pivot and the fourth pivot, the auxiliary frame carried by the casing in the second axis, and movement of the auxiliary frame detected by a second sensor, and an intermediate frame coupled to the auxiliary frame by a swivel joint. The control lever includes two pairs of arms fixed to the control lever, the control lever extending from the geometric pivot, a first pair of arms of the two pairs of arms interacting with the main frame and a second pair of arms of the two pairs of arms interacting with the auxiliary frame via the intermediate frame. The control lever is located on one side of a plane defined by the two pairs of arms, and the auxiliary frame and the intermediate frame are located on another side of the plane. Movement of the control lever is transmitted by the first pair of arms associated with the main frame and by the second pair of arms associated with the intermediate frame.

Thus, overall and according to the different embodiments, the remote controller of the disclosure has a particularly simple, robust and compact structure.

BRIEF DESCRIPTION OF THE DRAWINGS

The present disclosure is described in greater detail below with the aid of the attached drawings, in which.

DETAILED DESCRIPTION

Figure 1:
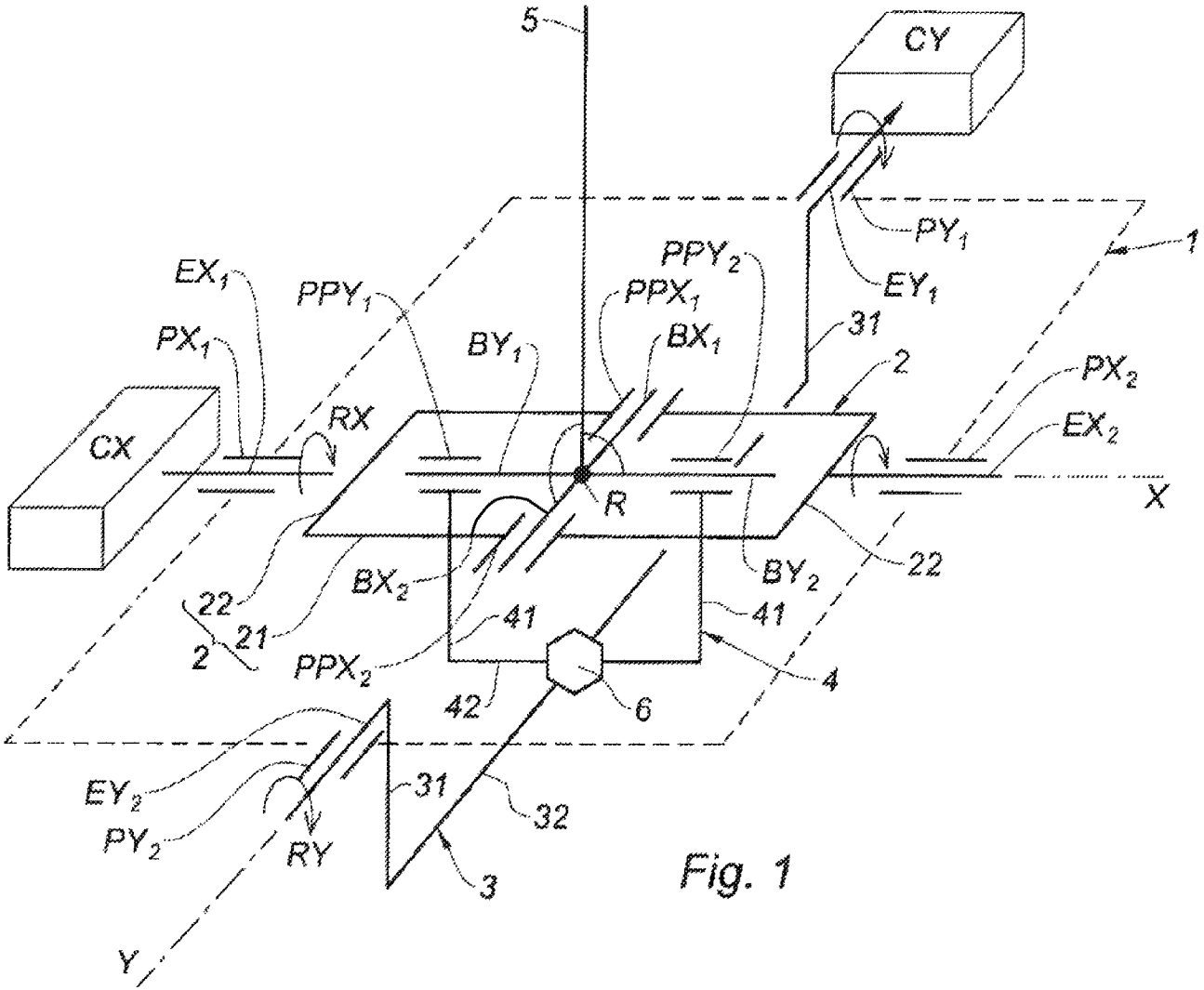
FIG. 1 is a schematic perspective view of a remote controller according to the disclosure.

FIG. 1, which is a schematic representation of an example of a remote controller for controlling the maneuvering of equipment such as a civil engineering machine or other machine is composed of a fixed body or casing 1 carrying a control lever 5 which is movable by pivoting about an imaginary pivot R defined as the intersection of the two axes X and Y about which the lever 5 can pivot with respect to a single axis or in a combined way with respect to both axes.

The fixed casing 1 carries a sensor CX associated with the X axis and a sensor CY associated with the Y axis, to detect the pivoting movements RX, RY about the axes X and Y associated with the lever 5, and to supply signals used to generate control signals for the equipment, as described in greater detail below.

The processing of the signals supplied by the sensors CX, CY is carried out in a known way, for generating the control signals.

The casing 1 receives a main frame 2 equipped with two shaft elements EX1, EX2 aligned on the X axis and housed in two fixed bearings PX1, PX2. These bearings are aligned on the X axis and are carried by the casing 1. The main frame 2 pivots with respect to the casing 1 about the X axis, as indicated by the arrow RX, through an angle of less than 180°.

In a plane transverse to the X axis, passing through the geometric pivot point R, the main frame 2 is equipped with two main bearings PPX1, PPX2 aligned on a straight line passing through the pivot R.

The main frame 2 is a structure defining, in general terms, two pivots (EX1/PX1; EX2/PX2) in the X axis and two pivots (PPX1, PPX2) in a transverse plane with respect to the X axis, containing the Y axis; that is to say, four coplanar pivots. The main frame, according to the example described here, is a rectangular structure formed by two longitudinal sides 21, parallel to the X axis and linked by transverse sides 22 joined to the longitudinal sides 21, and each carrying a main bearing PPX1, PPX2.

The casing 1 also has an auxiliary frame 3, which is a U-shaped part whose lateral branches 31 are joined by a transverse branch 32. The lateral branches 31 are joined at their other ends to a shaft element EY1, EY2. These elements EY1, EY2 are aligned on the Y axis and housed in two fixed bearings PY1, PY2 of the casing 1.

In general terms, the auxiliary frame 3 is coupled to the casing 1 by two pivots (EY1/PY1; EY2/PY2) aligned on the Y axis and transmitting the pivoting movement RY of the auxiliary frame 3 to the sensor CY.

The auxiliary frame 3 pivots with respect to the casing 1 about the Y axis. This pivoting, indicated by the double arrow RY, takes place through an angle of less than 180°.

The auxiliary frame 3 is coupled to a U-shaped intermediate frame 4 whose two lateral branches 41 are joined by a transverse branch 42. Each of the lateral branches 41 is joined at its other end to an auxiliary bearing PPY1, PPY2 aligned on the pivot R.

In general terms, the intermediate frame 4 has branches 41, each equipped with a pivot element (PPY1, PPY2) combined with a complementary pivot element of the lever 5, as described below.

The lever 5 is equipped with two pairs of arms BX1, BX2, BY1, BY2, fixed to the lever and extending from the pivot R, these arms being aligned on the directions X and Y in a certain position of the lever 5.

The pair of arms BX1,2 is engaged in the main bearings PPX1, PPX2. The pair of arms BY1,2 is engaged in the auxiliary bearings PPY1, PPY2, thus forming two pairs of pivots between the lever 5 and the main frame 2 or the intermediate frame 4.

The intermediate frame 4 is coupled by its transverse branch 42 to the transverse branch 32 of the auxiliary frame 3 by a swivel 6 which is a bearing whose axis passes through the pivot R.

The lever 5 is located on one side of the plane of the main frame 2, and the auxiliary frame 3, combined with the intermediate frame 4, is located on the other side of the plane of the main frame 2.

The movement of the lever 5 is transmitted to the sensor CX by the transmission system formed by the pair of arms BX1, 2 coupled to the main frame 2 by the main bearings PPX1, 2. The movement of the lever 5 is transmitted to the sensor CY by the transmission system formed by the pair of arms BY1,2, the bearings PPY1,2, the intermediate frame 4, the swivel 6 and the auxiliary frame 3.

The auxiliary frame 3 and the intermediate frame 4 are open frames, located under the plane of the X and Y axes so as not to interfere in movement with the main frame 2, and the auxiliary frame 3 is sufficiently open to pivot in the main frame 2; in other words, the intermediate frame 4 is sufficiently narrow, or alternatively the main frame 2 is sufficiently long, to allow the intermediate frame 4 to pivot freely in the main frame 2 within the range of control movements of the lever 5.

The same applies to the auxiliary frame 3, in which the space between the lateral branches 31 allows the main frame 2 to pivot.

It should be noted that the "shaft element/bearing" functions are relative concepts denoting pivots, and may be partially or wholly inverted for the pivots represented here:

the shaft elements may be replaced by bearings (female elements) and the bearings may be replaced by shaft elements (male elements).

The remote controller described above operates as follows:

In the simplest case, the pivoting of the lever 5 about the X axis causes the frame 2 to swing and causes the rotation RX of the shaft elements EX1, EX2; this rotation is detected by the sensor CX. If the lever 5 only swings about the X axis, this does not affect the intermediate frame 4, and the auxiliary frame 3 remains fixed.

The pivoting of the lever 5 about the Y axis causes the intermediate frame 4 to swing, and this swings the auxiliary frame 3 about the Y axis whose pivoting RY is detected by the sensor CY.

If the lever 5 only moves about the Y axis, this only causes the frames 4 and 3 to swing, and they retain their relative orientation.

The combined pivoting of the lever 5 about the X and Y axes simultaneously may be broken down into the swinging of the main frame 2 about the X axis, followed by pivoting about the arms BX1, 2 in the main frame 2 inclined in this way, so that one of the arms BY1 is raised (or lowered) and the other BY2 is lowered (raised) with respect to the plane of the main frame 2 which has swung. This corresponds to the pivoting of the intermediate frame 4 about the axis linking the pivot R to the swivel 6, whereas, for swinging about the X axis only, the intermediate frame 4 retains its orientation with respect to the auxiliary frame 3.

In the simplest case, since the remote controller has a symmetrical structure overall, the X and Y axes are perpendicular; generally, but not necessarily, the lever is perpendicular to the X and Y axes.

Although the basic shape of the frames 2, 3 and 4 is rectangular, other shapes can be envisaged. Thus the frame 2 may have a polygonal or curved shape linking its pivots. The auxiliary frame 3 may be triangular, in a V shape, as may the intermediate frame 4, provided that the shapes of the frames allow their relative movement.

Figure 2:
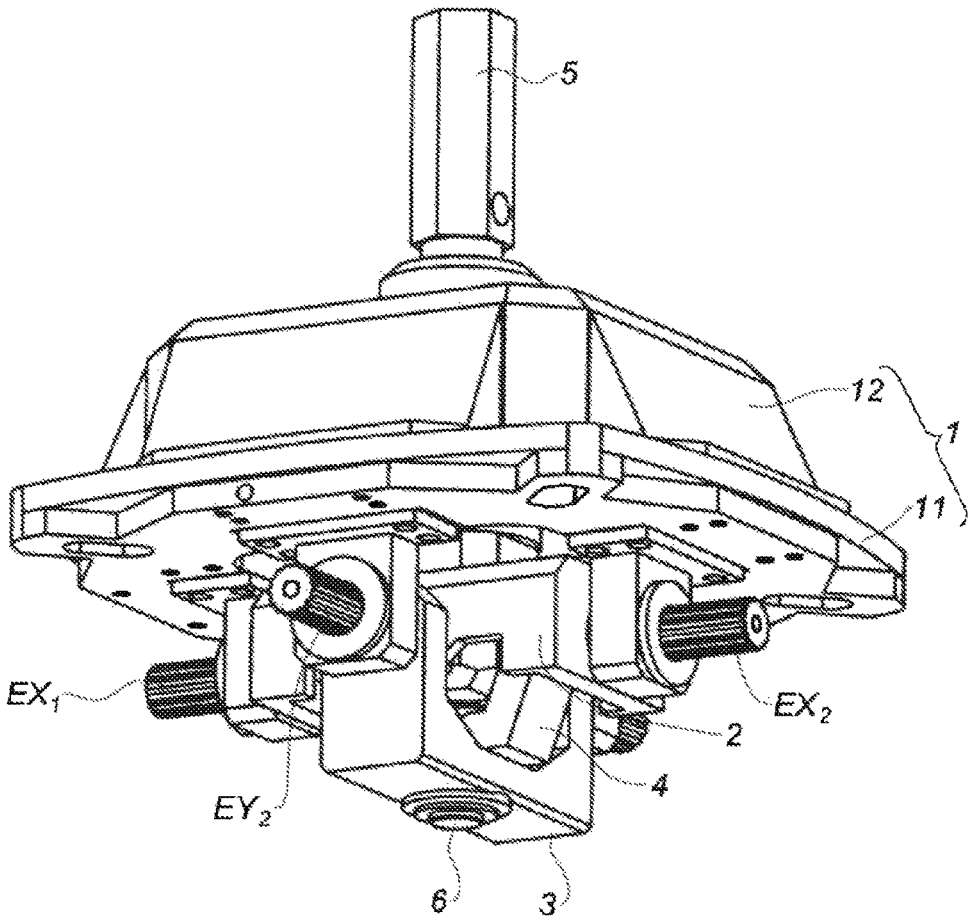
FIG. 2 is a schematic perspective view from below of an embodiment of a remote controller according to the disclosure.

FIG. 2 is a perspective view from below of an embodiment of the remote controller according to the disclosure. This view from below represents the remote controller without the pivoting sensors CX, CY. It shows the casing 1 formed by a plate 11 and a cover 12 from which the lever 5 projects, the lever being given a handle to make it easier to grip. The main frame 2, the auxiliary frame 3 and the intermediate frame 4, together with the swivel 6 coupling the auxiliary frame to the intermediate frame, can be seen under the plate 12.

Figure 3:
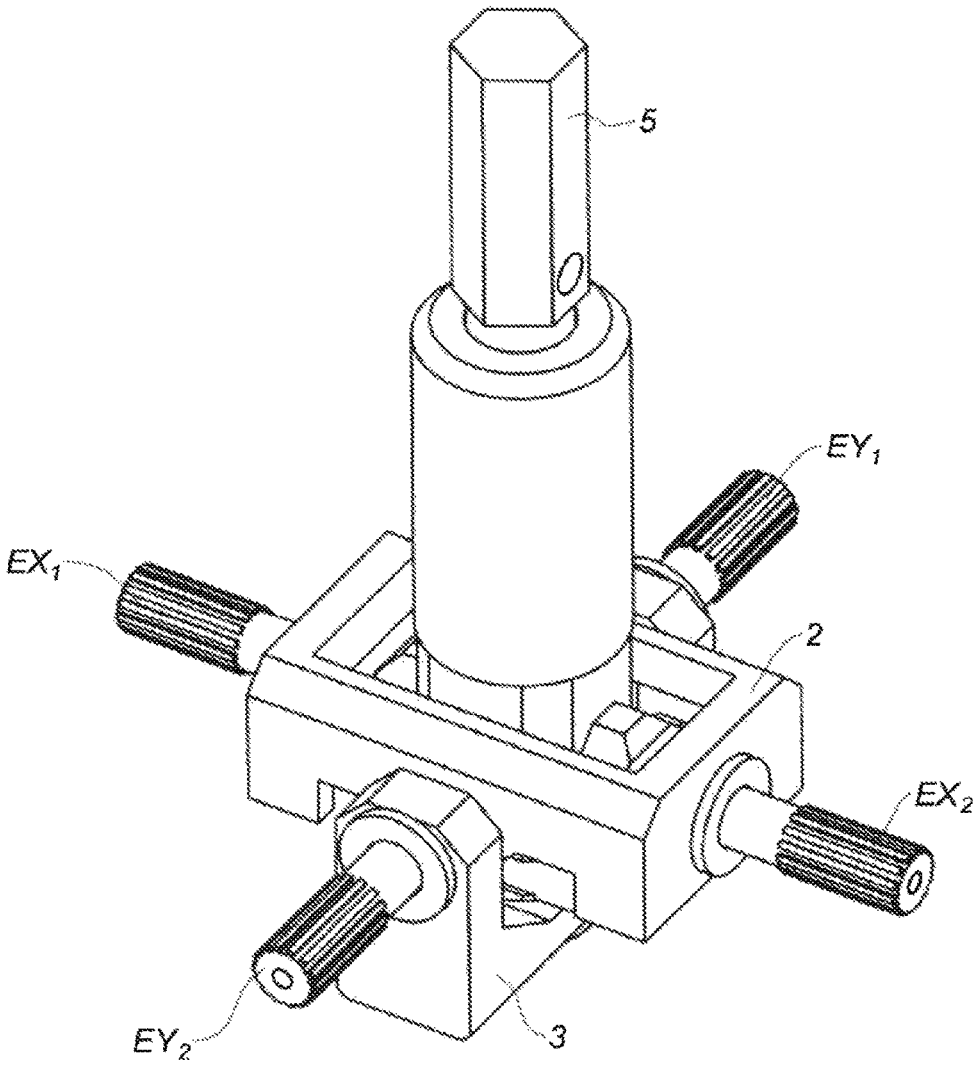
FIG. 3 is a top view of the structure composed of the main frame, the auxiliary frame and the intermediate frame of the remote controller according to the disclosure, in a perspective view from above.
Figure 4:
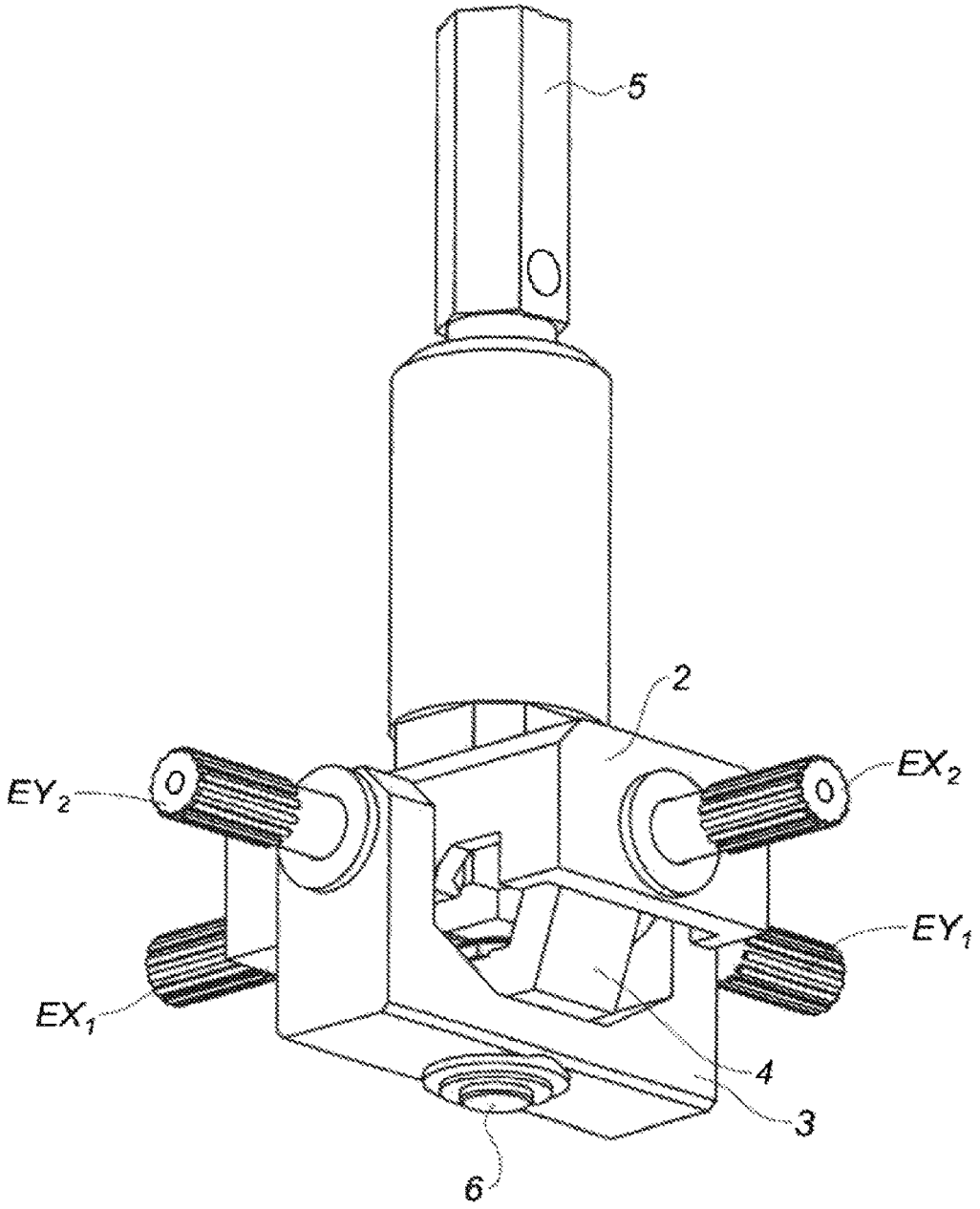
FIG. 4 is a perspective view from below of the part of the remote controller shown in FIG. 3.

FIG. 3 is a perspective view from above of the part of the remote controller shown in FIG. 2, but without the casing, that is to say without the plate 11 and the cover 12. This view, which also omits the pivoting sensors CX, CY, emphasizes the compactness of the remote controller, which facilitates its incorporation into equipment, such as a console or an armrest of a seat in a machine, in a particularly user-friendly way.

LIST OF THE MAIN ELEMENTS

1 Casing/body of the remote controller
2 Main frame
  21 Transverse branch
  22 Longitudinal branch
3 Auxiliary frame
  31 Lateral branch
  32 Transverse branch
4 Intermediate frame
  41 Lateral branch
  42 Transverse branch
5 Control lever
6 Swivel
X, Y Axis
PX1, PX2 Fixed bearing forming part of the casing
PY1, PY2 Fixed bearing forming part of the casing
CX Sensor for sensing pivoting RX about the X axis
CY Sensor for sensing pivoting RY about the Y axis
EX1, EX2 Shaft elements of the main frame
EY1, EY2 Shaft elements of the auxiliary frame
BX First pair of arms of the lever
BY Second pair of arms of the lever
R Geometric pivot of the lever
PPX1,2 Main bearing receiving the arm BX
PPY1,2 Auxiliary bearing receiving the arm BY
RX Pivoting about the X axis
RY Pivoting about the Y axis

What is claimed is:

1. A remote controller for machinery, comprising:

a casing having a first pivot and a second pivot defining a first axis, and a third pivot and a fourth pivot defining a second axis, the first axis and the second axis intersecting each other at a geometric point about which a control lever is configured to pivot when actuated by a user;

a main frame configured to pivot with respect to the casing by way of the first pivot and the second pivot, the main frame carried by the casing in the first axis, and pivoting movement of the main frame detected by a first sensor;

an auxiliary frame configured to pivot with respect to the casing by way of the third pivot and the fourth pivot, the auxiliary frame carried by the casing in the second axis, and movement of the auxiliary frame detected by a second sensor; and an intermediate frame coupled to the auxiliary frame by a swivel joint, wherein the control lever includes two pairs of arms fixed to the control lever, the control lever extending from the geometric pivot, a first pair of arms of the two pairs of arms interacting with the main frame and a second pair of arms of the two pairs of arms interacting with the auxiliary frame via the intermediate frame, wherein the control lever is located on one side of a plane defined by the two pairs of arms, and the auxiliary frame and the intermediate frame are located on another side of the plane, and wherein movement of the control lever is transmitted by the first pair of arms associated with the main frame and by the second pair of arms associated with the intermediate frame.

2. The remote controller according to claim 1, wherein the first sensor and the second sensor are carried by the casing.

3. The remote controller according to claim 1, wherein the first pivot and the second pivot are formed by two shaft elements engaged in fixed bearings aligned on the first axis of the casing.

4. The remote controller according to claim 1, wherein the auxiliary frame is a U-shaped part having two branches configured to terminate in the third pivot and the fourth pivot formed by shaft elements housed in fixed bearings of the casing.

5. The remote controller according to claim 1, wherein:

the intermediate frame is a U-shaped part having two lateral branches equipped with arm pivots formed by auxiliary bearings receiving the second pair of arms, and a transverse branch of the intermediate frame is coupled to an intermediate branch of the auxiliary frame by the swivel joint.

6. The remote controller according to claim 5, wherein the auxiliary frame is symmetrical and the intermediate frame is symmetrical, and the swivel joint is located in a first middle of the transverse branch of the intermediate frame and in a second middle of a transverse branch of the auxiliary frame.

7. The remote controller according to claim 1, wherein the first axis is orthogonal to the second axis, and first pair of arms are orthogonal to the second pair of arms.

8. The remote controller according to claim 1, wherein the swivel joint is a bearing defining a bearing axis passing through the geometric point, the bearing axis orthogonal to the first axis and the second axis.

9. The remote controller according to claim 1, wherein the auxiliary frame and the intermediate frame are movable under the plane and the lever is movable above the plane.

* * * * *